United States Patent [19]

Heinze et al.

[11] Patent Number: 4,639,943

[45] Date of Patent: Jan. 27, 1987

[54] X-RAY DIAGNOSTIC SYSTEM WITH AUTOMATIC CONTROL OF RADIATION EXPOSURE

[75] Inventors: Udo Heinze, Nuernberg; Paul Marhoff, Erlangen, both of Fed. Rep. of Germany

[73] Assignee: Siemens Aktiengesellschaft, Berlin and Munich, Fed. Rep. of Germany

[21] Appl. No.: 694,957

[22] Filed: Jan. 25, 1985

[30] Foreign Application Priority Data

Jan. 27, 1984 [DE] Fed. Rep. of Germany ..... 3402888

[51] Int. Cl.[4] ..... H05G 1/44

[52] U.S. Cl. ..... 378/96; 378/97; 378/99; 378/108; 378/112; 358/111

[58] Field of Search ..... 358/111; 378/99, 108, 378/112, 96, 97

[56] References Cited

U.S. PATENT DOCUMENTS

| | | | |
|---|---|---|---|
| 3,906,233 | 9/1975 | Vogel | 378/97 |
| 3,971,945 | 7/1976 | Franke | 378/96 |
| 4,007,373 | 2/1977 | Torguet et al. | 378/108 |
| 4,117,335 | 9/1978 | Franke | 378/108 |
| 4,121,104 | 10/1978 | Richter | 378/108 |

FOREIGN PATENT DOCUMENTS

| | | | |
|---|---|---|---|
| 0959298 | 9/1982 | U.S.S.R. | 378/108 |

*Primary Examiner*—Craig E. Church
*Assistant Examiner*—John C. Freeman
*Attorney, Agent, or Firm*—Hill, Van Santen, Steadman & Simpson

[57] ABSTRACT

An x-ray diagnostic system has a control loop with a first regulating stage connected to a first radiation detector disposed after the x-ray image intensifier, the first regulating stage controlling at least one radiographic exposure value in dependence upon the output signal of the detector, and a second radiation detector which is disposed proximate the x-ray tube for supplying an output signal to a second regulating stage in the control loop, the second regulating stage having a memory for storing a signal which is dependent upon the dose rate for the last image. The memory signal is utilized as a reference signal for the second regulating stage. If the operator of the x-ray system determines that the contrast in the diagnostically relevant image region is becoming too great, the operator can switch from control of the system by the first regulating stage to control by the second regulating stage.

7 Claims, 1 Drawing Figure

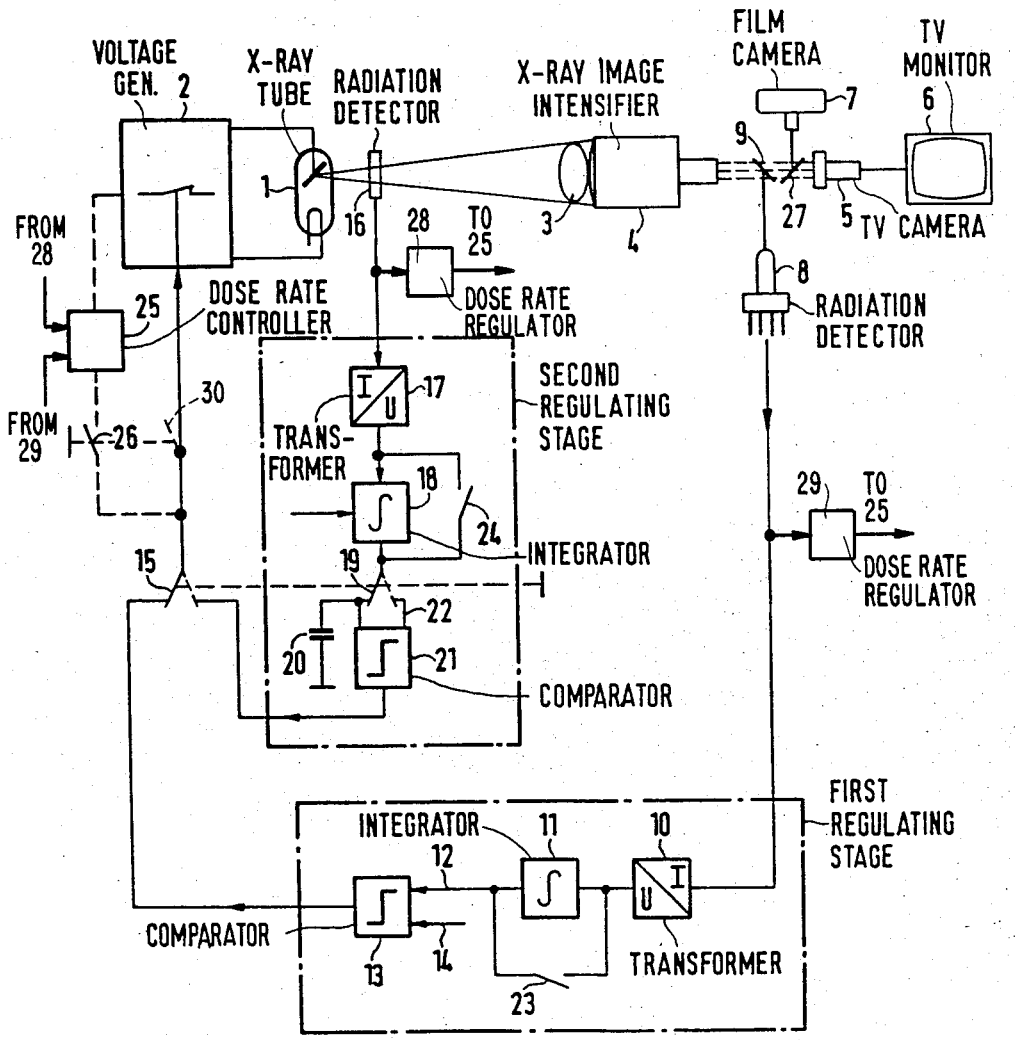
VOLTAGE GEN. 2
X-RAY TUBE
RADIATION DETECTOR
X-RAY IMAGE INTENSIFIER
FILM CAMERA
TV MONITOR
6
7
9
1
16
3
4
27
5
TV CAMERA
FROM 28
28
TO 25
DOSE RATE REGULATOR
25
DOSE RATE CONTROLLER
8
RADIATION DETECTOR
SECOND REGULATING STAGE
17
TRANS-FORMER
30
FROM 29
26
18
24
INTEGRATOR
29
TO 25
DOSE RATE REGULATOR
15
19
22
20
21
COMPARATOR
FIRST REGULATING STAGE
INTEGRATOR
11
10
12
COMPARATOR
13
14
TRANSFORMER
23

X-RAY DIAGNOSTIC SYSTEM WITH AUTOMATIC CONTROL OF RADIATION EXPOSURE

BACKGROUND OF THE INVENTION

1. Field of the Invention

The present invention relates to x-ray diagnostic systems having a control loop or automatic control system, and in particular to such diagnostic systems having a radiation detector for detecting the mean radiation dose and a means for influencing or regulating at least one radiographic exposure value in dependence upon the output of the detector.

2. Description of the Prior Art

X-ray diagnostic systems are known having a control loop which includes an integrator for integrating the signal from a radiation detector and for automatically disconnecting the high voltage supply to the x-ray tube when the integrated output of the detector reaches a predetermined dose per image. A control loop of this type is generally referred to as an automatic exposure timer. In x-ray diagnostic systems of this type, optimally exposed x-ray images are obtained. Another type of automatic exposure timer is known which utilizes a photomultiplier connected after the x-ray image intensifier as the radiation detector, the photomultiplier detecting the mean image brightness in the ray trace between the output fluorescent screen of the image intensifier and an image recording device (such as a television camera) in a predetermined region. False exposures may nonetheless occur when the contrast in the region detected by the radiation detector varies during a series. Such false exposures may arise, for example, when an x-ray contrast agent flows into the detected region because the presence of the contrast agent causes the mean image brightness to be maintained substantially constant, due to the high radiation absorption of the contrast agent, and this artificial image brightness may deviate considerably from a diagnostically significant value.

SUMMARY OF THE INVENTION

It is an object of the present invention to provide an x-ray diagnostic system which has a control loop which minimizes the possibility of an incorrect radiation dosage which may otherwise occur given the presence of a false exposure.

The above object is inventively achieved in an x-ray diagnostic system having an automatic control loop which includes a first radiation detector disposed after the image intensifier for supplying a signal to a first regulating stage for controlling the voltage supply to the x-ray tube, and having a second tube-proximate radiation detector which supplies a signal to a second regulating stage which can be switched into the control loop while simultaneously cutting out the first regulating stage when the system operator determines that the contrast in the diagnostically relevant image region is becoming too great. Automatic switch over from the first regulating stage to the second regulating stage may also be undertaken after a test series.

In the x-ray diagnostic system disclosed herein, if a false exposure occurs in the image region detected by the first radiation detector, for example due to a high image contrast change caused by a contrast agent flowing into the region, switch over to the second tube-proximate radiation detector, which is disposed in front of the patient in the direction of radiation propogation, is undertaken, the tube-proximate radiation detector already supplying an output signal to the second regulating stage even before switch over. The output signal of the tube-proximate radiation detector is stored in a memory, this signal corresponding to the dose of the last image which occurred before switch over from the first regulating stage to the second regulating stage. After switch over, this dose is kept constant through the remainder of the image series, thereby achieving an optimum image density even after switch over, it being assumed that the dose necessary for an optimum image density will not change during the series.

DESCRIPTION OF THE DRAWING

The single FIGURE is a schematic block diagram of an x-ray diagnostic system constructed in accordance with the principles of the present invention.

DESCRIPTION OF THE PREFERRED EMBODIMENTS

As shown in the drawing, an x-ray system constructed in accordance with the principles of the present invention has an x-ray tube 1 which is supplied by a voltage generator 2 for generating an x-ray beam which radiates a patient 3. X-ray images are first formed on the inlet fluorescent screen of an x-ray image intensifier 4, which generates an output image received by a television camera 5 and displayed on a television monitor 6. In addition, the output image of the image intensifier 4 may be retained by means of a film camera 7, the image being supplied thereto by a semi-transmissive mirror 27 which is disposed in the ray trace between the output fluorescent screen of the image intensifier 4 and the television camera 5. Another semitransmissive mirror 9 disposed in the same ray trace directs a portion of the output of the image intensifier 4 to a first radiation detector 8, such as a photomultiplier. The radiation detector 8 detects the mean image brightness in a predetermined region of the image.

The output of the first radiation detector 8 is supplied to a first regulating stage in the control loop for the system and is converted to a voltage in a transformer 10 which is integrated in an integrator 11. The output of the integrator 11 is supplied to a signal input of a switching unit 13, such as a comparator, having a reference signal supplied to a reference input 14. The signal at the input 12 of the switching unit 13 corresponds to the dose which has accumulated for one image. If and when the signal at the input 12 of the switching unit 13 equals the value of the reference signal supplied at the input 14, the switching unit 13 disconnects the voltage generator 2 from the x-ray tube 1 by means of a normally closed switch schematically illustrated within the voltage generator 2. The output of the switching unit 13, and thus the output of the first regulating stage, is normally connected to the voltage generator 2 through a switch 15, which is normally in the position indicated by the solid line.

The x-ray system includes a second tube-proximate radiation detector 16 which supplies an output signal to a transformer 17 in a second regulating stage. The voltage output of the transformer 17 is integrated in an integrator 18 and the output of the integrator 18 is stored in a memory 20 through a switch 19, which is normally in the position indicated by the solid line. The output of the memory 20 is supplied to a switching unit 21 in the second regulating stage as a reference signal. The switching unit 21 also has a signal input 22.

If the operator of the x-ray diagnostic system determines that the contrast in the diagnostically relevant image region is becoming too great, for example, because contrast agent is arriving in that region, the operator then simultaneously activates switches 15 and 19, shifting those switches to the respective positions indicated by the dashed lines. This switching operation may also proceed automatically after a test series. The switch 15 disconnects the output of the first regulating stage from the voltage generator 2, and simultaneously connects the output of the second regulating stage thereto. The switch 19 causes the output of the integrator 18 to be supplied to the switching unit 21 as an input signal and the memory 20, as stated above, then supplies a reference signal to the other input of the switching unit 21. The stored signal which is supplied as a reference voltage to the switching unit 21 corresponds to the dose attained with the last image prior to actuation of the switches 15 and 19, the radiation detector 16 supplying signals to the second regulating stage even though the second regulating stage may not be as yet cut into the control loop. The memory 20 is reset or discharged after each image, as is the integrator 18.

After the second regulating stage is cut into the control loop, the images are automatically attained with a dose which was utilized for the last image of the series which was controlled by the first regulating stage before switching of the switches 15 and 19. It is assumed this dose results in optimum image density and will not significantly change for the remainder of the series. The arrival of a contrast agent in the detection region does not affect the output signal of the radiation detector 16, and hence the optimum image density will also be unaffected. When the second regulating stage is cut into the control loop, main voltage fluctuations, variations in the x-ray tube current due to the reactive effect of the anode, beat effects in the case of a non-main-synchronous clock pulse utilized to pulse the x-ray tube 1, and the influences of transient phenomena in the x-ray tube high voltage are significnatly leveled or controlled. In particular, in the case of digital subtraction angiography, the second regulating stage is advantageous because the demand for an extremely high dose constancy during an entire radiographic series exists.

If the x-ray tube voltage is not pulsed, but is instead continuous, the dose rate may be selectively regulated by means of the radiation detectors 8 and 16. For this purpose, the outputs of the detectors 8 and 16 may be supplied to respective dose rate regulators 29 and 28, the outputs of the dose rate regulators 29 and 28 being in turn supplied to a dose rate controller 25 connected to the voltage generator 2. The dose rate controller 25 may be cut into the circuit by a switch 26. In this case, the connection between the switch 15 and the voltage generator 2 is opened as indicated by the dashed-line position of a switch 30 simultaneously operated with the switch 26. Simultaneously, switches 23 and 24 are closed which respectively bridge integrators 11 and 18 for generating a brightness-proportional signal when the regulating stages are also used for dose rate control. The dose rate controller 25 will thereafter regulate the voltage generator 2 based on the output of whichever regulating stage is cut into the circuit. During an adjustment phase, the dose rate at the x-ray tube 1 is detected and stored. The stored value then serves as a nominal value after switch over.

Although modifications and changes may be suggested by those skilled in the art it is the intention of the inventors to embody within the patent warranted hereon all changes and modifications as reasonably and properly come within the scope of their contribution to the art.

We claim as our invention:

1. An x-ray diagnostic system having an x-ray tube, a voltage source for operating said x-ray tube, and a control loop for controlling at least one radiographic exposure parameter of said x-ray tube, said control loop comprising:

a first radiation detector disposed for detecting an x-ray image of an examination subject;

a first regulating stage connected to an output of said first radiation detector for controlling said parameter based on said first radiation detector output, said first regulating stage having an output;

a second radiation detector disposed before said examination subject in the direction of radiation propagation;

a second regulating stage for controlling said parameter based on said second radiation detector output having a memory supplied through a first switch in a first switching position with a signal derived from said output of said second radiation detector and storing said signal, and a switching unit having a signal input, a reference input connected to said memory, and an output which is the output of said second regulating stage; and a second switch operated simultaneously with said first switch, said second switch in a first switching position connecting said output of said first regulating stage to said voltage source for operating said x-ray tube, and when switched to a second switching position disconnecting said output of said first regulating stage and connecting said output of said second regulating stage to said voltage source for operating said x-ráy tube, said first switch when simultaneously switched to a second switching position supplying said signal derived from said output of said second radiation detector to said signal input of said switching unit for thereafter maintaining said parameter at a value stored in said memory.

2. An x-ray diagnostic system as claimed in claim 1 wherein said first regulating stage includes a first integrator having an input connected to the output of said first radiation detector, and a further switching unit having a signal input connected to the output of said first integrator and a reference input, said switching unit having an output which is the output of said first regulating stage from which a control signal is supplied through said second switch to said means for operating said x-ray tube for changing said radiographic exposure parameter when the output of said first integrator equals a signal supplied to said reference input of said further switching unit; and wherein said second regulating stage has a second integrator having an input connected to the output of said second radiation detector for generating said signal derived from said second radiation detector, said second integrator having an output connected to said first switch.

3. An x-ray diagnostic system as claimed in claim 1 wherein said voltage source for operating said x-ray tube operates said x-ray tube continuously and wherein said parameter is the radiation dose rate, and further comprising:

a first dose rate regulator connected to said output of said first radiation detector for generating a first dose rate signal based thereon;

a second dose rate regulator having an input connected to said output of said second radiation detector for generating a second dose rate signal based thereon;

a dose rate controller having respective inputs connected to the outputs of said first and second dose rate regulators and interconnected between said second switch and said voltage source for operating said x-ray tube; and a third switch interconnected between said dose rate controller and said second switch for selectively cutting said dose rate controller into said control loop and means operated simultaneously with said third switch for disconnecting said second switch from said voltage source so as to operate said x-ray tube controlled by said first and second dose rate signals and the output of the regulating stage connected to said dose rate controller dependent upon the position of said second switch.

4. An x-ray diagnostic system as claimed in claim 3 wherein each of said first and second regulating stages includes an integrator, and further comprising fourth and fifth normally open switches respectively bridging said integrators in said first and second regulating stages and operated simultaneously with said third switch.

5. An x-ray diagnostic system as claimed in claim 1, wherein said parameter is the radiation dose rate.

6. An x-ray diagnostic system as claimed in claim 1, wherein said system generates a series of successive x-ray images, and wherein said second regulating stage maintains said parameter at a value stored in said memory which is for a last x-ray image occurring before said first and second switches are switched.

7. A control system for an x-ray diagnotics installation having an x-ray tube operated by a voltage source for generating a series of successive x-ray images of a subject, said control system comprising:

a tube-proximate radiation detector disposed in the path of x-radiation between said x-ray tube and said subject;

a tube-distant radiation detector disposed in the path of x-radiation after said subject;

a first regulating stage having a comparator supplied with a signal derived from an output of said tube distant detector and also supplied with a constant reference signal for generating a control signal for said voltage source for controlling the radiation output of said x-ray tube such that the signal derived from the output of said tube distant detector is maintained below said reference signal;

a second regulating stage having a first switch supplied with a signal derived from the output of said tube proximate detector, a memory to which said first switch supplies said signal derived from the output of said tube proximate detector in a first switching position for storage therein, and a further comparator having a reference input connected to said memory and a signal input to which said first switch supplies said signal derived from the output of said tube proximate detector in a second switching position for generating a control signal for said voltage source for controlling the radiation output of said x-ray tube such that said signal derived from the output of said tube proximate detector is maintained at a last signal stored in said memory for an x-ray image occurring immediately before said switch changes position; and a second switch operated simultaneously with said first switch for connecting the first regulator stage to said voltage source when said first switch is in said first position and connecting said second regulating stage to said voltage source when said first switch is in said second position.

* * * * *